US007270441B2

(12) United States Patent
Fiene

(10) Patent No.: US 7,270,441 B2
(45) Date of Patent: Sep. 18, 2007

(54) LUMINAIRE WITH SPECIAL BALLAST

(75) Inventor: Dale E. Fiene, Algonquin, IL (US)

(73) Assignee: Ole K. Nilssen, Bonita Springs, FL (US)

( * ) Notice: Subject to any disclaimer, the term of this patent is extended or adjusted under 35 U.S.C. 154(b) by 183 days.

(21) Appl. No.: 10/940,694

(22) Filed: Sep. 14, 2004

(65) Prior Publication Data

US 2006/0056172 A1 Mar. 16, 2006

(51) Int. Cl.
*F21S 8/00* (2006.01)

(52) U.S. Cl. ..... 362/147; 362/221; 362/263; 362/265; 362/290; 362/354; 336/107

(58) Field of Classification Search ..... 362/147, 362/263, 265, 290, 354; 336/107
See application file for complete search history.

(56) References Cited

U.S. PATENT DOCUMENTS

| | | | | |
|---|---|---|---|---|
| 4,399,371 A | | 8/1983 | Ziff et al. | 307/147 |
| 4,500,796 A | | 2/1985 | Quinn | 307/39 |
| 4,626,747 A | | 12/1986 | Nilssen | 315/209 R |
| 4,631,648 A | | 12/1986 | Nilssen | 362/150 |
| 4,651,059 A | | 3/1987 | Nilssen | 315/182 |
| 4,667,133 A | | 5/1987 | Nilssen | 315/312 |
| 5,003,227 A | | 3/1991 | Nilssen | 315/161 |
| 5,047,696 A | | 9/1991 | Nilssen | 315/312 |
| 5,132,884 A | | 7/1992 | Totten | 362/147 |
| 5,260,678 A | * | 11/1993 | Van Wagener et al. | 336/96 |
| 5,479,326 A | | 12/1995 | Nilssen | 362/148 |
| 5,640,069 A | | 6/1997 | Nilssen | 315/209 R |
| 5,691,603 A | | 11/1997 | Nilssen | 315/209 R |
| 5,998,936 A | | 12/1999 | Nilssen | 315/209 R |
| 6,260,981 B1 | | 7/2001 | Fiene | 362/147 |
| 6,435,693 B1 | | 8/2002 | Fiene | 362/147 |
| 6,439,736 B1 | | 8/2002 | Fiene | 362/147 |

* cited by examiner

*Primary Examiner*—Sandra O'Shea
*Assistant Examiner*—Meghan K. Dunwiddie

(57) ABSTRACT

A luminaire has a ballasting circuit assembly for a gas discharge lamp, with an input power connector assembly suitable for receiving and connecting with a mating multi-conductor connector assembly. A ballasting circuit in the ballasting circuit assembly is suitable for powering a gas discharge lamp. Output leads suitable for connecting to a gas-discharge lamp socket with the wiring therefore are contained within the luminaire.

49 Claims, 8 Drawing Sheets

LUMINAIRE WITH SPECIAL BALLAST

This invention relates generally to a luminaire having a gas-discharge lamp ballast and, more particularly, to a luminaire with gas-discharge lamp ballast that reduces the time it takes to install and wire the gas-discharge lamp ballast within the luminaire during the assembly process of the luminaire and also minimizes the time to install the luminaire at the job site.

BACKGROUND OF THE INVENTION

A lighting assembly is generally referred to as a luminaire. This structure generally includes a housing assembly with a lamp mounted in a socket contained therein. Additionally, if the light source of the luminaire is a gas-discharge lamp, somewhere in the area of the socket and housing assembly is a ballast, which is connected to the lamp sockets. The input connection to the ballast is generally a pair of wires that are left unconnected and connected at a latter time to the source of input power during the final installation of the luminaire.

Cables with connectors to interconnect luminaires as shown in Quin, U.S. Pat. No. 4,500,796 and Nilssen, U.S. Pat. No. 5,640,069 can be used to reduce the time and cost to install the luminaire, but this requires additional assembly time in the factory to complete the wiring between the ballast power input and the input power connector.

Leadless electronic ballasts that incorporated connectors, developed during the early 1990s by Motorola Lighting, Inc., are designed to accept individual stripped wire leads to make connection to the power source. This for some applications reduced installation time, but still required the luminaire to be opened and the ballast cover to be removed in order to make the connection. Then the ballast cover had to be replaced and the luminaire closed.

SUMMARY OF THE INVENTION

Among the many objectives of this invention is the provision of an improved luminaire incorporating a lightweight ballasting assembly.

It is another objective of the present invention to provide a luminaire having a ballast with simplified connections.

It is another objective of the present invention to provide a luminaire having a ballast that requires less time to install.

Still another objective of the present invention is to provide a luminaire having an ease of installation.

These and other objectives of the invention (which other objectives become clear by consideration of the specification, claims and drawings as a whole) are met by providing a luminaire having a ballasting circuit assembly for a gas discharge lamp, with a multi-conductor input power connector suitable for receiving and connecting with a mating multi-conductor power connector attached to a multi-conductor cable, a ballasting circuit suitable for powering a gas discharge lamp, output leads suitable for connecting to a gas-discharge lamp socket with the wiring therefore contained within the luminaire.

BRIEF DESCRIPTION OF THE DRAWINGS

These and other features, objects and advantages of the present invention will become apparent from the following description and drawings wherein like reference numerals represent like elements in several views and in which.

| | |
|---|---|
| 10 | luminaire |
| 12 | top aperture |
| 14 | high-frequency ballasting assembly |
| 16 | high-frequency ballast output lead |
| 18 | multi-conductor power connector |
| 20 | ballast backing plate |
| 22 | side aperture |
| 24 | ballast output connector |
| 26 | housing assembly input connector |
| 28 | conventional ballast (magnetic or electronic) |
| 30 | armored cable |
| 32 | input lead |
| 34 | ground lead |
| 36 | output lead |
| 38 | junction box |
| 40 | wire nut |
| 42 | junction box cover plate |
| 44 | lamp socket |
| 46 | cap assembly |
| 48 | lamp |
| 50 | retaining ring |
| 52 | lip |
| 54 | mounting plate |
| 56 | mating multi-conductor power connector |
| 58 | multi-conductor cable |
| 60 | housing assembly |

PRIOR ART

Figure 1:
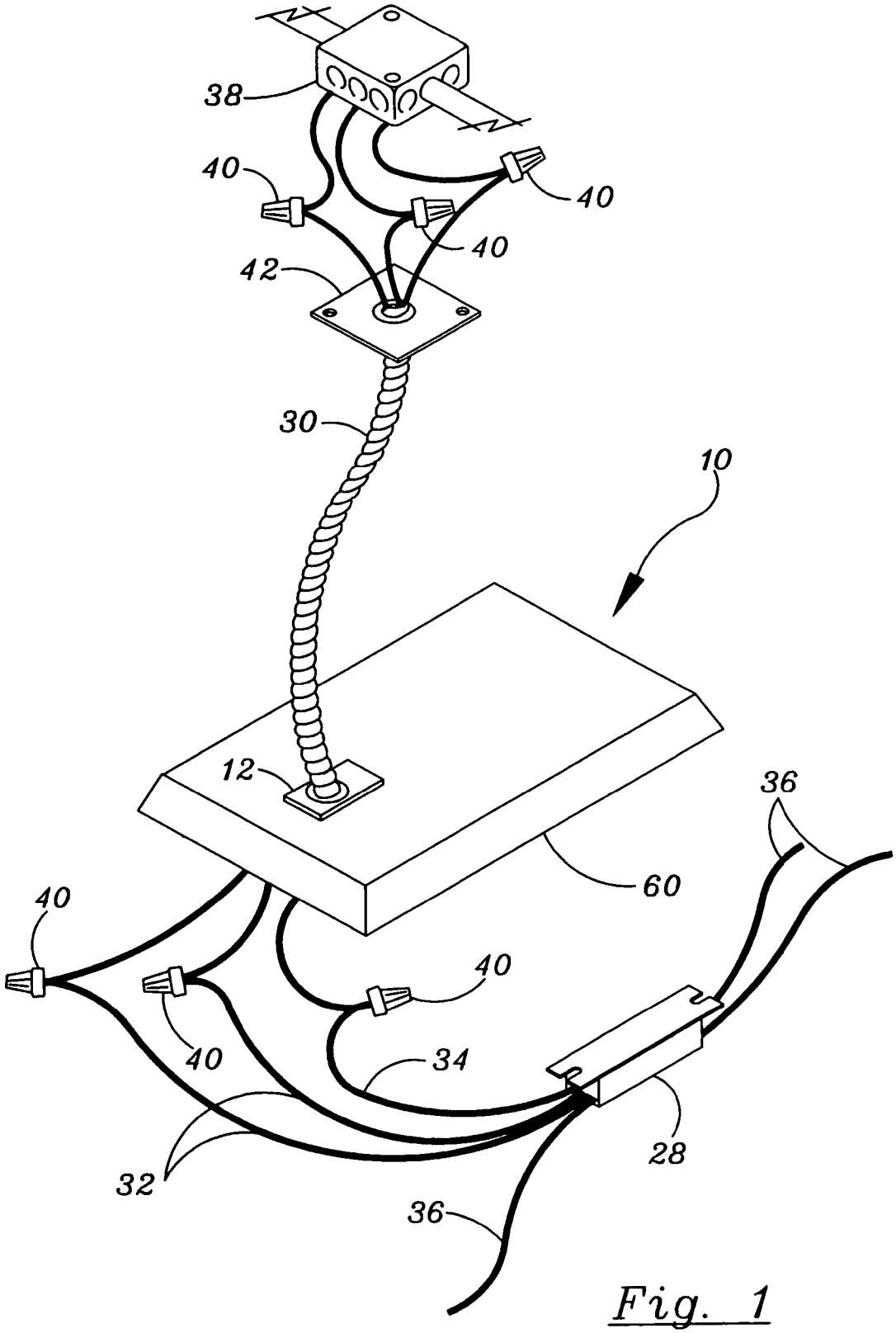
Fig. 1 (Prior Art)
FIG. 1 depicts an exploded perspective view of the luminaire 10 with conventional ballast 28.

FIG. 1 is representative of the way the majority of troffer type luminaires are constructed and installed. A conventional ballast (electronic or magnetic) 28 is connected to lampholders through output leads 36. The input power to the conventional ballast is supplied through input leads 32, which are connected to the leads of an armored cable 30 using wire nuts 40. If the luminaire has any dead metal parts they must be grounded using a ground lead 34. These connections are made within the luminaire and the luminaire must be partially disassembled by an electrician to make the connection. The opposite end of the armored cable is connected through a junction box 38 where the leads of the armored cable are connected to the utility power source again using wire nuts 40 and again requiring an electrician to make the connection. The connections are then enclosed within the junction box with a junction box cover 42. This construction is representative of the prior art of troffer type luminaires.

Figure 6:
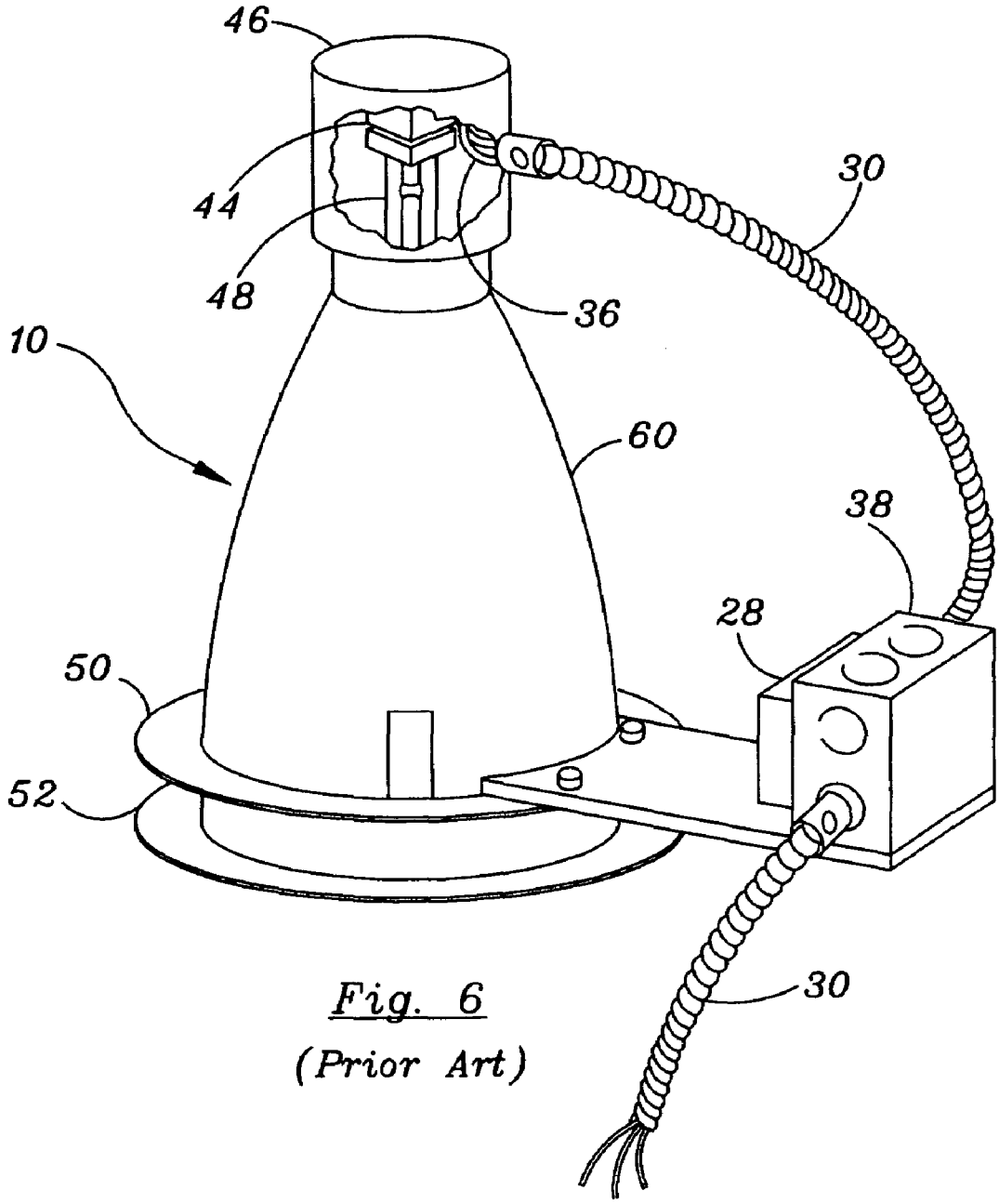
Fig. 6 (Prior Art)
FIG. 6 depicts a perspective view of a luminaire 10 with conventional ballast 28 mounted on the outside of a junction box 38.

FIG. 6 is representative of the way a downlight luminaire using a gas-discharge lamp is constructed. An armored cable 30 is run from a junction box as described above. The armored cable 30 goes to a second junction box 38 on which a conventional ballast 28 is mounted. The output leads 36 of the ballast are run through a second armored cable 30 and connect to lamp socket 44. The lamp socket is mounted in a cap assembly 46. The cap assembly is mounted on one end of housing assembly 60. This is representative of the prior art of downlight type luminaires.

DESCRIPTION OF THE PREFERRED EMBODIMENTS

The instant invention overcomes the problems of the prior art by incorporating a multi-conductor input power connector into the ballasting assembly that is capable of accepting a mating multi-conductor connector on a cable to provide input power to the ballast and thus the luminaire. By locating the ballast external to the luminaire or within the luminaire such that the input power connector is accessible through an access hole in the luminaire, the need to open the luminaire to connect input power or the need to add wiring between a connector and the ballast is eliminated. Such a structure can be a great advancement in the art.

A luminaire has a high-frequency ballasting circuit assembly for a gas discharge lamp that is connectable to a power source that is suitable for interconnecting the power source and the luminaire with flexible, non-armored cables. On the ballasting circuit assembly is a multi-conductor power connector suitable for receiving and connecting with a multi-conductor cable having a mating multi-conductor connector. The ballasting circuit within the assembly provides an appropriate voltage and current to ignite and power at least one gas discharge lamp when connected to an appropriate power source. Output leads suitable for connecting the ballast output to a gas-discharge lamp socket has the wiring circuit therefore contained within the luminaire.

In a first embodiment (FIG. 2), a luminaire has lamp sockets that are wired to a multi-terminal connector mounted onto the housing assembly of the luminaire. The terminals of the connector are accessible from the outside of the housing assembly through a top aperture. A high-frequency ballasting circuit assembly has an enclosure enclosing the high-frequency ballasting circuit assembly. At least a first multi-conductor power connector is adapted to receive and connect with a mating multi-conductor power connector provided on multi-conductor cable to provide input power to the ballasting circuitry. The ballasting circuitry includes a first wiring circuit connecting a first multi-conductor power connector to the ballasting circuit input. A second wiring circuit connects the output of the ballasting circuitry to a ballast output connector. The ballasting circuitry is adapted to power a gas-discharge lamp. The ballast output connector is adapted to engage and provide connection with the multi-terminal connector mounted onto the housing assembly. When so engaged and provided with an appropriate source of power the ballasting circuitry assembly powers at least one gas-discharge lamp inserted within a gas-discharge lamp socket. The gas-discharge lamp socket being mounted within the luminaire.

For a second embodiment (FIG. 3), a luminaire has a top aperture. A high-frequency ballasting circuit assembly has an enclosure enclosing the high-frequency ballasting circuit assembly. At least a first multi-conductor power connector is adapted to receive and connect with a mating multi-conductor power connector provided on a multi-conductor cable to provide input power to the ballasting circuitry. The ballasting circuitry includes a first wiring circuit connecting a first multi-conductor power connector to the ballasting circuit input. A second wiring circuit connects the output of the ballasting circuitry to high-frequency ballast output leads. The high-frequency ballasting circuit assembly is mounted within the luminaire under the top aperture of the luminaire, such that, the at least first multi-conductor power connector is accessible through the aperture. The high-frequency ballast output leads are wired to at least one lamp socket mounted within the luminaire.

A third embodiment (FIG. 4), is similar to the second embodiment except a first multi-conductor power connector of the high-frequency ballasting circuit assembly is relocated from the top side of the assembly to the side. The top aperture of the luminaire is replaced with a side aperture.

Now turning to the fourth structure (FIG. 5), this embodiment is also similar to the second embodiment except that the high-frequency ballasting circuit assembly is mounted on the outside surface of the luminaire instead of the inside surface the first multi-conductor power connector of the high-frequency ballasting circuit assembly is thus still accessible from outside of the luminaire. The high-frequency output leads of the high-frequency ballasting circuit assembly protrude through a top aperture of the luminaire and connect with at least one lamp socket for a gas-discharge lamp.

Now turning to the fifth structure (FIG. 7), a luminaire has a housing assembly with a top aperture. A high-frequency ballasting circuit assembly has an enclosure enclosing the high-frequency ballasting circuit assembly. The housing includes a mounting plate to permit the high-frequency ballasting circuit assembly to be mounted over the top aperture of the luminaire. At least a first multi-conductor power connector is adapted to receive and connect with a mating multi-conductor power connector provided on multi-conductor cable to provide input power to the ballasting circuitry. The ballasting circuitry includes a first wiring circuit connecting a first multi-conductor power connector to the ballasting circuit input. A second wiring circuit connects the output of the ballasting circuitry to high-frequency ballast output leads. The high-frequency ballast output leads are wired to at least one lamp socket mounted one the opposite side of the mounting plate.

Now turning to the sixth structure (FIG. 8), is similar to the fifth structure except that the housing assembly is fitted with a cap assembly. The high-frequency ballast assembly is mounted externally to the cap assembly. A lamp socket is mounted within the cap assembly. The lamp socket is connected to the high-frequency ballast assembly via high-frequency output leads.

Now turning to the seventh structure (FIG. 9), a luminaire has a housing assembly with a side aperture. A high-frequency ballasting circuit assembly has a housing enclosing the high-frequency ballasting circuit assembly. The housing includes a mounting plate to permit the high-frequency ballasting circuit assembly to be mounted over the side aperture of the luminaire. At least a first multi-conductor power connector is adapted to receive and connect with a mating multi-conductor power connector provided on a multi-conductor cable to provide input power to the ballasting circuitry. The ballasting circuitry includes a first wiring circuit connecting a first multi-conductor power connector to the ballasting circuit input. A second wiring circuit connects the output of the ballasting circuitry to high-frequency ballast output leads. The high-frequency ballast output leads are wired to at least one lamp socket mounted one the opposite side of the mounting plate.

Figure 2:
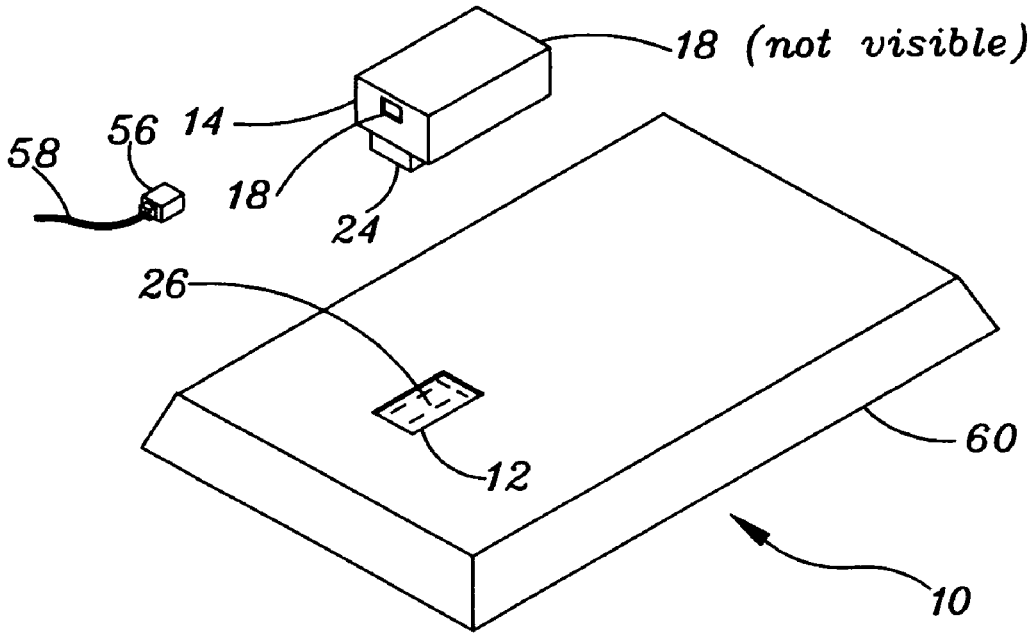
FIG. 2 depicts an exploded perspective view of the luminaire 10 with high-frequency ballasting assembly 14 on the outside of housing assembly 60 this invention.

Referring now to FIG. 2, extending below high-frequency ballasting assembly 14 and integrally connected therewith is ballast output connector 24. Luminaire 10 includes the housing assembly 60 having a top aperture 12. Mounted within aperture 12 is housing assembly input connector 26. The housing assembly input connector 26 is wired to at least one lamp socket mounted within the housing assembly 60. Through top aperture 12, the ballast output connector of the high-frequency ballasting assembly 14 may be connected to mate with housing assembly input connector 26. Any suitable mating multi-conductor power connector 56 may be connected to the multi-conductor power connector 18 of ballasting assembly 14.

Adding FIG. 3 to consideration, ballast backing plate 20 permits installation of the high-frequency ballasting assembly 14 within housing assembly 60 and directly below the top aperture 12 of housing assembly 60. From ballasting assembly 14 extend high-frequency ballast output leads 16. Multi-conductor power connector 18 is shown accessible from the top of the high-frequency ballasting assembly 14.

Figure 3:
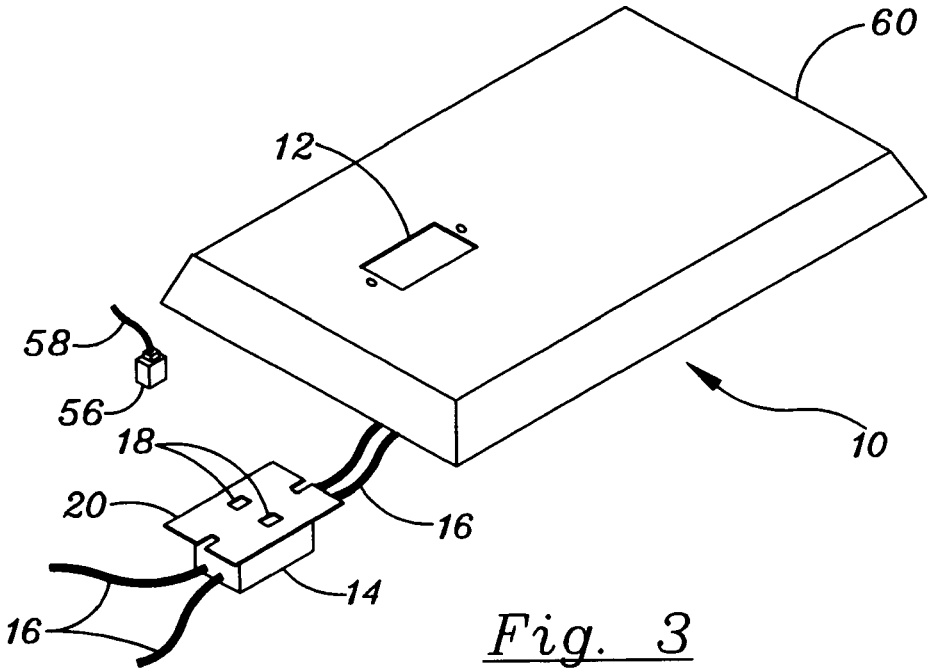
FIG. 3 depicts a perspective view of the luminaire 10 with high-frequency ballasting assembly 14 on the inside of housing assembly 60 of this invention.
Figure 4:
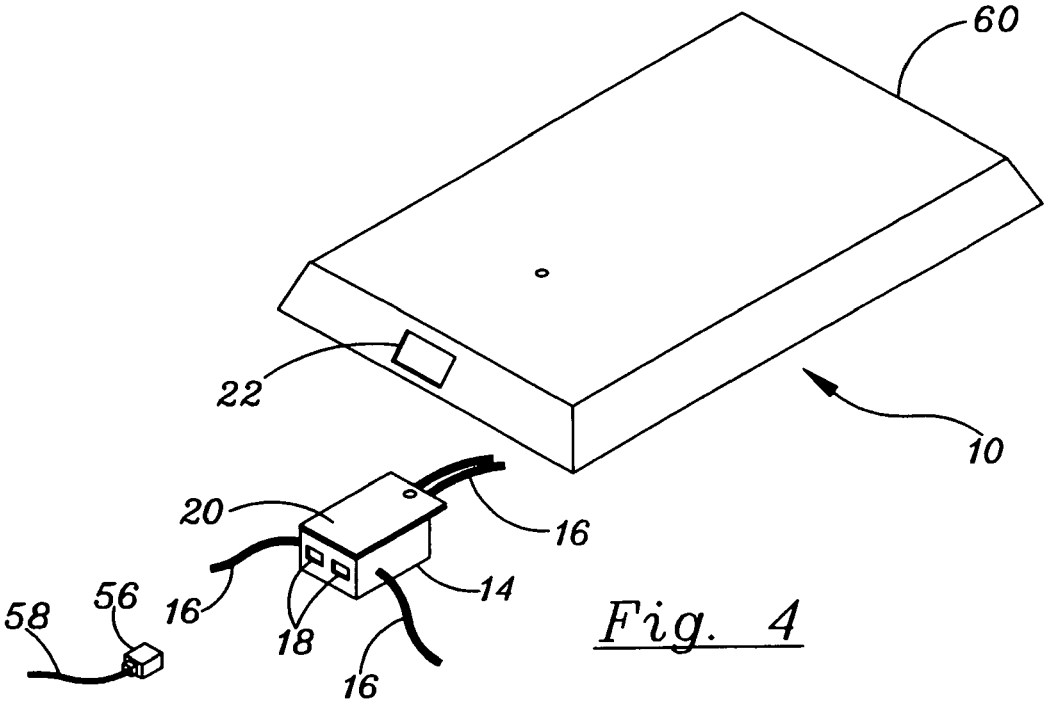
FIG. 4 depicts a perspective view of the luminaire 10 with high-frequency ballasting assembly 14 on the inside of housing assembly 60 this invention.

FIG. 4 is similar to FIG. 3, except that top aperture 12 is replaced with side aperture 22 on the side of housing assembly 60. The multi-conductor power connector 18 of ballasting assembly 14 is located on the side of high-frequency ballasting assembly 14.

Figure 5:
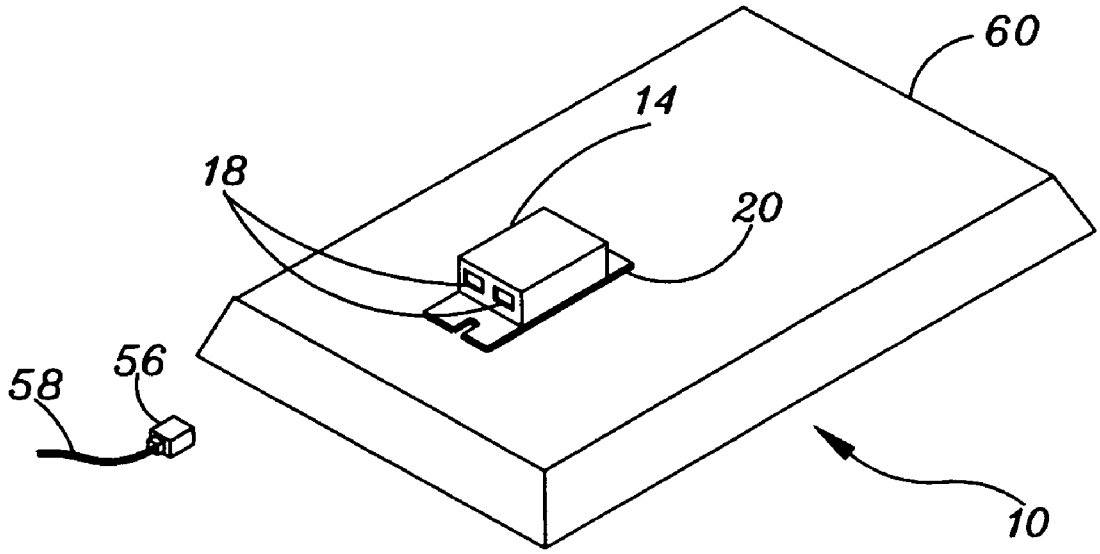
FIG. 5 depicts a perspective view of the luminaire 10 with high-frequency ballasting assembly 14 on the outside of housing assembly 60 of this invention.

FIG. 5 is similar to FIG. 3, except that high-frequency ballasting assembly 14 is positioned on the top side of housing assembly 60. Ballast backing plate 20 permits the attachment of high-frequency ballasting assembly 14 to housing assembly 60.

Figure 7:
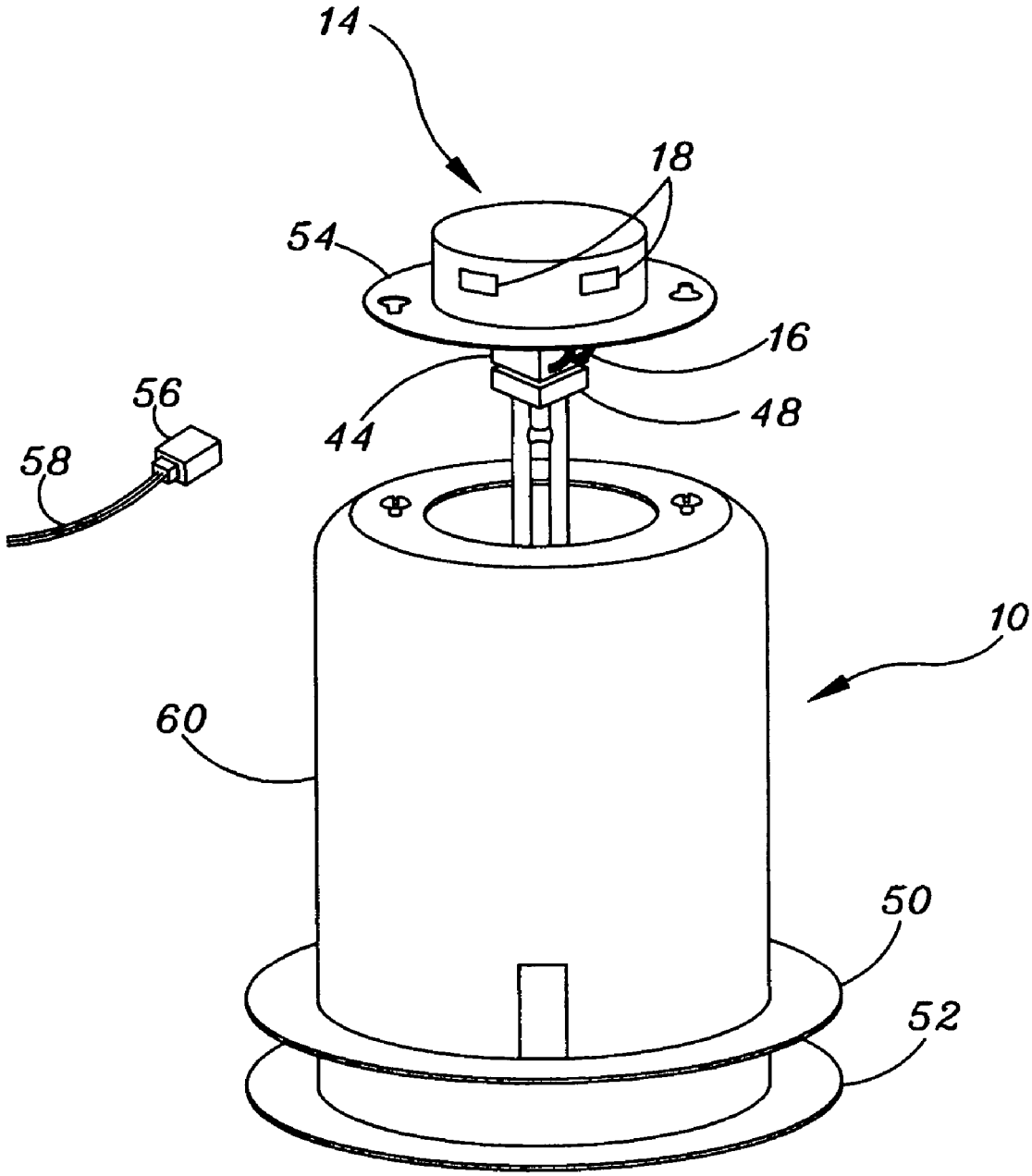
FIG. 7 depicts an exploded perspective view of the luminaire 10 with high-frequency ballasting assembly 14 incorporating a mounting plate 54 of this invention.

Referring now to FIG. 7, luminaire 10 for a downlight is cylindrical in nature. Housing assembly 60 has a lip 52 and retaining ring 50. High-frequency ballasting assembly 14 is positioned on the top of housing assembly 60. Mounting plate 54 permits the attachment of high-frequency ballasting assembly 14 to housing assembly 60. The mounting plate 54 may be either removably attached to, permanently attached to, or be built into housing assembly 60. The high-frequency ballasting assembly 14 includes at least one multi-conductor power connector 18 capable of receiving and connecting with a suitable mating multi-conductor power connector attached to a multi-conductor cable 58. Lamp 48 is inserted into lamp socket 44. Lamp socket 44 is connected to the output of the high-frequency ballasting circuitry by way of high-frequency output leads 16.

Figure 8:
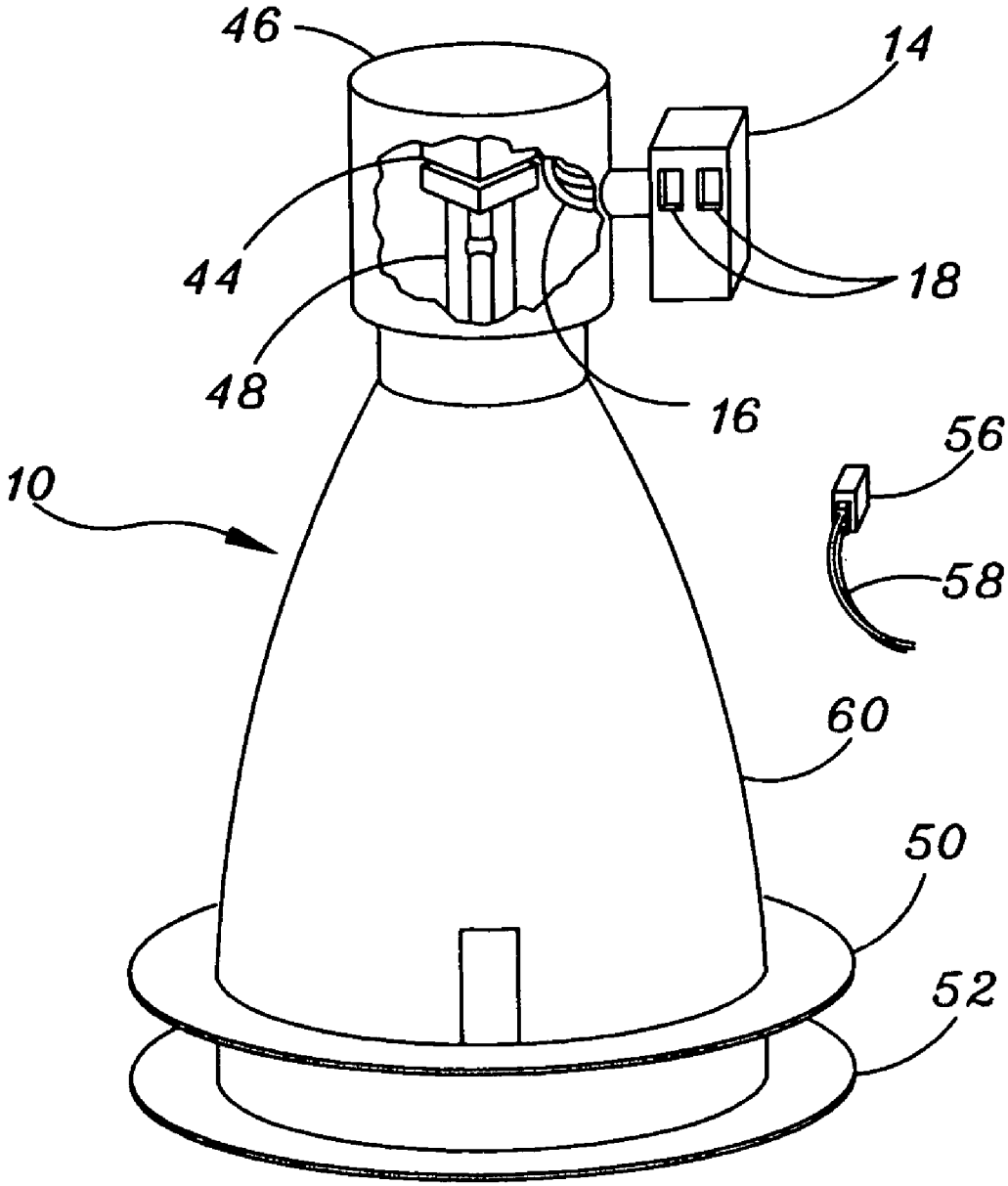
FIG. 8 depicts a perspective view of the luminaire 10 with high-frequency ballasting assembly 14 on the outside of cap assembly 46 of this invention.

FIG. 8 is similar to FIG. 7 except the housing assembly is not cylindrical, but has inward slanting sides. The aperture at the upper part of the housing assembly is substantially smaller than the aperture at the bottom. A cap assembly 46 is affixed to the smaller aperture. Mounted within the cap assembly 46 is a lamp socket 44 holding lamp 48. The lamp socket 44 is connected to a high-frequency ballasting assembly 14 mounted externally to the cap assembly 46 by way of at least two high-frequency output leads 16.

Figure 9:
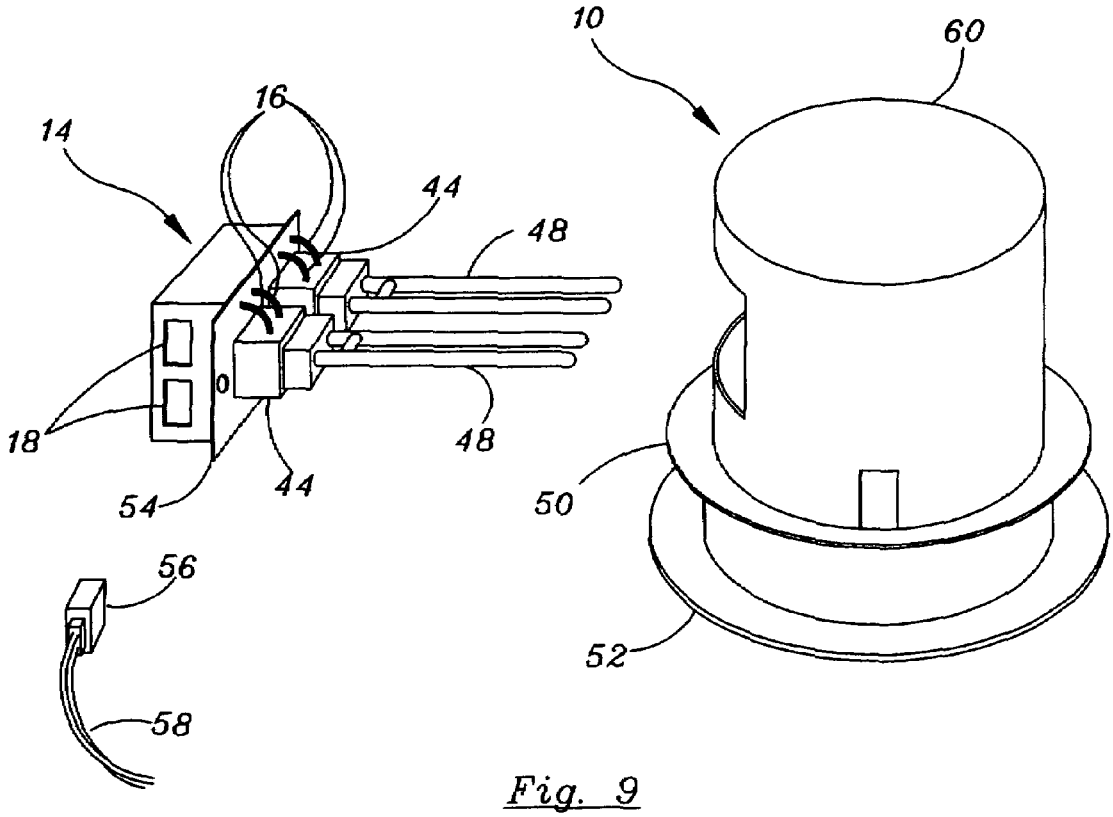
FIG. 9 depicts an exploded perspective view of the luminaire 10 with high-frequency ballasting assembly 14 on the outside of housing assembly 60 of this invention.

FIG. 9 is also similar to FIG. 7 except the housing assembly 60 is of a larger diameter and the lamp 48 is installed substantially horizontal instead of substantially vertical. The high-frequency ballasting assembly 14 includes a mounting plate 54 that attaches to the side of the housing assembly 60. It should be noted that although the housing assembly 60 is shown in the figure as a cylinder having a circular cross-section, a housing constructed in the form of a box having a rectangular cross-section as well as all the variations between can also be used. The high-frequency ballasting assembly attaches to at least one lamp socket 44 via at least two high-frequency ballast output leads 16.

There are a number of variations that can be applied to any one of the above embodiments, for instance the figure and description discuss the multi-conductor power connectors being flush with the enclosure of the high-frequency ballasting assembly and that the mating multi-conductor connector extends through the aperture of the housing assembly. An alternative embodiment includes having the multi-conductor power connectors protrude from the enclosure of the high-frequency ballasting assembly so that it will extend through the aperture of the housing assembly and the mating multi-conductor connector can make connection without extending through the aperture. Another alternative embodiment includes having the multi-conductor power connectors being furnished at the ends of cables that extend through the aperture of the housing assembly thus the mating multi-conductor connector will not pass through the aperture. Still another embodiment includes having the high-frequency ballasting assembly incorporate a cable with a multi-conductor cable at one end to connect directly to a mating multi-conductor connector at the source of power.

Also for the downlight type luminaires, the high-frequency ballasting assembly may be mounted within the luminaire with the multi-conductor power connector being accessible through an aperture, but the higher ambient operating temperature for the ballasting circuitry makes this arrangement useful, but less desirable.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

I claim:

1. A luminaire comprising: a housing assembly, a lamp socket for a gas discharge lamp, an input connector and a ballasting circuit assembly;

the ballasting circuit assembly having at least one power connector for connection to a power source;

the ballasting circuit assembly including an output connector;

the lamp socket for a gas discharge lamp not being enclosed within the ballasting circuit assembly;

the housing assembly having an inner surface and an outer surface;

the housing assembly having an input connector having connections to the lamp socket; and the ballasting circuit assembly being mountable on or adjacent to the outer surface, thereby permitting the output connector to engage and make a proper connection with the input connector.

2. The luminaire of claim 1 further comprising the ballasting circuit assembly lacking a solid-state inverter.

3. The luminaire of claim 1 further comprising:

the at least one power connector being at least two power connectors; and the at least two power connectors being wired in order for a first member of the group of at least two power connectors to be connected to a source of power and a second member of the group of at least two power connectors to be connected to a second luminaire.

4. The luminaire of claim 1 further comprising the ballasting circuit assembly being connected to a power source with a frequency greater than 60 Hertz.

5. The luminaire of claim 1 further comprising the ballasting circuit assembly being connected to a direct current power source.

6. The luminaire of claim 1 wherein the power source is electronically limited to be no greater than a certain level.

7. The luminaire of claim 6 wherein said certain level is equal to or less than 250 Watts or 250 Volt-Amperes.

8. The luminaire of claim 1 wherein the ballasting circuit assembly has an input power cable replacing the power connector.

9. The luminaire of claim 1 further comprising:

the ballasting circuit assembly having at least one power connector; and the ballasting circuit assembly having an input power cable.

10. The luminaire of claim 9 further comprising the ballasting circuit assembly having at least one power connector wired in parallel with an input power cable.

11. The luminaire of claim 1 wherein the at least one power connector is a multi-conductor connector suitable for receiving and making contact with a mating multi-conductor connector.

12. A luminaire comprising: a housing assembly, a lamp socket suitable for receiving a gas discharge lamp, and a ballasting circuit assembly;

the ballasting circuit assembly having at least one power connector for connection to a power source;

the lamp socket suitable for receiving a gas discharge lamp not being enclosed within the ballasting circuit assembly;

the housing assembly including an aperture;

the housing assembly having an inside and an outside; and the ballasting circuit assembly being mounted on the inside of the housing assembly.

13. The luminaire of claim 12 further comprising the at least one power connector being accessible through the aperture from the outside.

14. The luminaire of claim 12 further comprising the at least one power connector protruding through the aperture.

15. The luminaire of claim 12 further comprising the ballasting circuit assembly lacking a solid-state inverter.

16. The luminaire of claim 12 further comprising:

the at least one power connector being at least two power connectors; and the at least two power connectors being wired to permit a first member of the group of at least two power connectors to be connected to a source of power and a second member of the group of at least two power connectors to be connected to a second luminaire.

17. The luminaire of claim 12 further comprising the ballasting circuit assembly being connected to a power source with a frequency greater than 60 Hertz.

18. The luminaire of claim 12 further comprising the ballasting circuit assembly being connected to a direct current power source.

19. The luminaire of claim 12 wherein the power source is electronically limited to be no greater than a certain level.

20. The luminaire of claim 19 wherein said certain level is equal to or less than 250 Watts or 250 Volt-Amperes.

21. The luminaire of claim 12 wherein the ballasting circuit assembly has an input power cable replacing the power connector.

22. The luminaire of claim 21 wherein the input power cable extends through the aperture.

23. The luminaire of claim 12 further comprising:

the ballasting circuit assembly having at least one power connector; and the ballasting circuit assembly having an input power cable.

24. The luminaire of claim 23 further comprising the ballasting circuit assembly having at least one power connector wired in parallel with an input power cable.

25. The luminaire of claim 12 further comprising the at least one power connector is a multi-conductor connector suitable for receiving and making contact with a mating multi-conductor connector.

26. A luminaire comprising: a housing assembly, a lamp socket suitable for receiving a gas discharge lamp, and a ballasting circuit assembly;

the housing assembly having an inside surface and an outside surface;

the ballasting circuit assembly having at least one power connector for connection to a power source;

the ballasting circuit assembly having at least two output leads for connecting at least one lamp socket;

the lamp socket suitable for receiving a gas discharge lamp not being enclosed within the ballasting circuit assembly;

the ballasting circuit assembly being mounted on the outside surface;

the housing assembly having at least one aperture; and the output leads from the ballasting circuit assembly being connected to the lamp socket through the aperture.

27. The luminaire of claim 26 further comprising the ballasting circuit assembly lacking a solid-state inverter.

28. The luminaire of claim 26 further comprising:

the at least one power connector being at least two power connectors; and the at least two power connectors being wired to permit a first member of the group of at least two power connectors to be connected to a source of power and a second member of the group of at least two power connectors to be connected to a second luminaire.

29. The luminaire of claim 26 further comprising the ballasting circuit assembly being connected to a power source with a frequency greater than 60 Hertz.

30. The luminaire of claim 26 further comprising the ballasting circuit assembly being connected to a direct current power source.

31. The luminaire of claim 26 wherein the power source is electronically limited to be no greater than a certain level.

32. The luminaire of claim 31 wherein said certain level is equal to or less than 250 Watts or 250 Volt-Amperes.

33. The luminaire of claim 26 wherein the ballasting circuit assembly has an input power cable replacing the power connector.

34. The luminaire of claim 26 further comprising:

the ballasting circuit assembly having at least one power connector; and the ballasting circuit assembly having an input power cable.

35. The luminaire of claim 34 further comprising the ballasting circuit assembly having at least one power connector wired in parallel with an input power cable.

36. A luminaire including: a housing assembly, a lamp socket, a gas discharge lamp, a cap assembly and a ballasting circuit assembly;

the ballasting circuit assembly being affixed directly to the cap assembly;

the lamp socket not being enclosed within the ballasting circuit assembly;

the lamp socket being mounted within the cap assembly; and the cap assembly being affixed to the housing assembly.

37. The luminaire of claim 36 further comprising the ballasting circuit assembly including at least one power connector.

38. The luminaire of claim 36 further comprising:

the ballasting circuit assembly including at least two power connectors; and the at least two power connectors being wired to permit a first member of the group of at least two power connectors to be connected to a source of power and a second member of the group of at least two power connectors to be connected to a second luminaire.

39. The luminaire of claim 36 further comprising the ballasting circuit assembly being connected to a power source with a frequency greater than 60 Hertz.

40. The luminaire of claim 36 further comprising the ballasting circuit assembly being connected to a direct current power source.

41. The luminaire of claim 36 further comprising the ballasting circuit assembly being connected to a power source;

the power source including an electronic device capable of limiting the available power to be less than a certain level.

42. The luminaire of claim 41 wherein said certain level is equal to or less than 250 Watts or 250 volt-amperes.

43. A luminaire comprising: a housing assembly, a lamp socket, a gas discharge lamp, a cap assembly and a ballasting circuit assembly;

the ballasting circuit assembly being affixed directly to the cap assembly;

the ballasting circuit assembly including the ballasting circuit;

the lamp socket not being enclosed within the ballasting circuit assembly;

the lamp socket being mounted within the cap assembly;

the cap assembly being affixed to the housing assembly; and the ballasting circuit assembly including an input power cable affixed to the ballast circuit assembly.

44. A luminaire including: a housing assembly, a lamp socket, a gas discharge lamp, and a ballasting circuit assembly;

the housing assembly having an interior and an exterior;

the ballasting circuit assembly being affixed directly to the exterior of the housing assembly;

the lamp socket not being enclosed within the ballasting circuit assembly; and the lamp socket being mounted within the interior of the housing assembly.

45. A luminaire including: a housing assembly, at least one lamp socket, a gas discharge lamp, and a ballasting circuit assembly;

the ballasting circuit assembly including an attachment mechanism;

the at least one lamp socket not being enclosed within the ballasting circuit assembly;

the housing assembly having an aperture having a complimentary mechanism to receive the attachment mechanism; and the lamp socket being mounted to the attachment mechanism.

46. The luminaire of claim 45 wherein the aperture is on the side of the housing assembly.

47. The luminaire of claim 45 wherein the aperture is on the end of the housing assembly.

48. The luminaire of claim 45 wherein the ballasting circuit assembly includes at least one power connector.

49. The luminaire of claim 45 wherein the ballasting circuit assembly includes at least two power connectors; and the at least two power connectors are wired to permit a first member of the group of at least two power connectors to be connected to a source of power and a second member of the group of at least two power connectors to be connected to a second luminaire.

* * * * *